US008490800B2

(12) United States Patent
Noble Colin

(10) Patent No.: US 8,490,800 B2
(45) Date of Patent: Jul. 23, 2013

(54) GRAVITY FEED DISPLAY RACK

(75) Inventor: Maria Alejandra Noble Colin, Del Magdalena Contreras (MX)

(73) Assignee: Sabritas, S. de R.L. de C.V., Colonia Lomas de Chapultepec (MX)

( * ) Notice: Subject to any disclaimer, the term of this patent is extended or adjusted under 35 U.S.C. 154(b) by 127 days.

(21) Appl. No.: 12/780,378

(22) Filed: May 14, 2010

(65) Prior Publication Data

US 2011/0278245 A1 Nov. 17, 2011

(51) Int. Cl.
*A47F 5/08* (2006.01)

(52) U.S. Cl.
USPC ..... 211/150; 211/59.2; 211/190; 211/187

(58) Field of Classification Search
USPC ..... 211/59.2, 103, 150, 184, 187, 149, 211/190, 207, 175; 108/60, 61, 106–110, 108/181, 193, 147.11
See application file for complete search history.

(56) References Cited

U.S. PATENT DOCUMENTS

| | | | | | |
|---|---|---|---|---|---|
| 65,152 | A | | 5/1867 | Anthony | |
| 234,452 | A | | 11/1880 | Ayres | |
| 1,705,237 | A | * | 3/1929 | Bulman | 108/8 |
| 2,963,170 | A | * | 12/1960 | Lori | 108/8 |
| 2,964,200 | A | | 12/1960 | King | |
| 3,151,576 | A | * | 10/1964 | Patterson | 108/2 |
| 3,393,888 | A | | 7/1968 | Henningsgard | |
| 3,534,863 | A | * | 10/1970 | Howard | 211/47 |
| 3,550,891 | A | * | 12/1970 | Scott | 248/242 |
| 3,700,114 | A | * | 10/1972 | Myers | 211/150 |
| 3,797,790 | A | | 3/1974 | Iseki | |
| 3,921,539 | A | * | 11/1975 | Berger | 108/8 |
| 4,065,088 | A | * | 12/1977 | Shell | 248/242 |
| 4,099,624 | A | * | 7/1978 | McKearin | 211/42 |
| 4,688,681 | A | * | 8/1987 | Bergeron | 211/36 |
| 4,762,235 | A | * | 8/1988 | Howard et al. | 211/59.3 |
| 5,351,923 | A | | 10/1994 | Booth, Jr. | |
| 5,439,122 | A | * | 8/1995 | Ramsay | 211/187 |
| 5,641,083 | A | * | 6/1997 | Metcalf | 211/187 |
| 5,749,480 | A | * | 5/1998 | Wood | 211/169.1 |
| 5,816,419 | A | * | 10/1998 | Lamson | 211/150 |
| 5,988,410 | A | * | 11/1999 | Mandle | 211/133.1 |
| 6,041,720 | A | * | 3/2000 | Hardy | 108/60 |
| 6,053,115 | A | * | 4/2000 | Felton | 108/107 |
| 6,164,462 | A | * | 12/2000 | Mumford | 211/59.2 |
| 6,170,678 | B1 | * | 1/2001 | de la Fuente | 211/59.2 |
| 6,205,934 | B1 | * | 3/2001 | Felton et al. | 108/107 |

(Continued)

OTHER PUBLICATIONS

"Display Shelving Components" by Lozier Corporation, found at http://www.lozier.com/mod5-ic.htm, dated Nov. 18, 2005.

*Primary Examiner* — Darnell Jayne
*Assistant Examiner* — Hiwot Tefera
(74) *Attorney, Agent, or Firm* — Bobby W. Braxton; Colin P. Cahoon; Carstens & Cahoon, LLP

(57) ABSTRACT

A gravity feed product display rack. In one embodiment the display rack has a support frame and at least one shelf. The at least one shelf has a floor, a front side, and at least one edge side, all integrally made. The shelf further has a hinge coupled to at least one edge side of the shelf via an affixing device. The hinge has a first stable position corresponding to a loading position and a second stable position corresponding to a displaying position. The shelf can be adjusted between the loading and displaying positions by adjusting the shelf relative to the affixing member.

24 Claims, 9 Drawing Sheets

U.S. PATENT DOCUMENTS

| | | | | |
|---|---|---|---|---|
| 6,273,276 | B1 * | 8/2001 | Upton et al. | 211/59.2 |
| 6,302,282 | B1 * | 10/2001 | Gay et al. | 211/153 |
| 6,311,852 | B1 * | 11/2001 | Ireland | 211/59.2 |
| 6,585,120 | B2 * | 7/2003 | Robertson | 211/59.2 |
| 6,651,828 | B2 * | 11/2003 | Dimattio et al. | 211/59.2 |
| 7,048,131 | B2 | 5/2006 | Gay et al. | |
| 7,128,221 | B2 | 10/2006 | Metcalf | |
| 7,350,649 | B1 * | 4/2008 | Martens | 211/90.02 |
| 7,896,171 | B2 * | 3/2011 | Battaglia | 211/59.2 |
| 2002/0027115 | A1 * | 3/2002 | Gay et al. | 211/187 |
| 2005/0039641 | A1 * | 2/2005 | Metcalf | 108/106 |
| 2007/0295681 | A1 * | 12/2007 | Colin | 211/90.03 |
| 2010/0078402 | A1 * | 4/2010 | Davis et al. | 211/184 |
| 2010/0108625 | A1 * | 5/2010 | Meers et al. | 211/59.3 |

* cited by examiner

GRAVITY FEED DISPLAY RACK

BACKGROUND OF THE INVENTION

1. Technical Field

The present invention relates to a gravity feed display rack.

2. Description of Related Art

Product is typically stored and displayed on a display rack. The rack can comprise one or more shelves. One type of shelf is a gravity feed shelf whereby gravity forces the product to the front of the shelf. This has several benefits including a more pleasing product arrangement since all the product is at the front of the shelf. Further, because the product is at the front of the shelf a consumer does not have to reach to the back of the shelf to retrieve the product.

Many shelves are metallic. This can result in several disadvantages. First, metallic shelves are often heavy. Thus, significant support is often required to hold the shelf itself, let alone any product. Second, metallic shelves often rust or wear over time. If the shelf comprises moving parts then these metallic parts often become difficult to manipulate over time. Consequently, it is desirable to have a shelf which overcomes these problems not addressed in the prior art.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
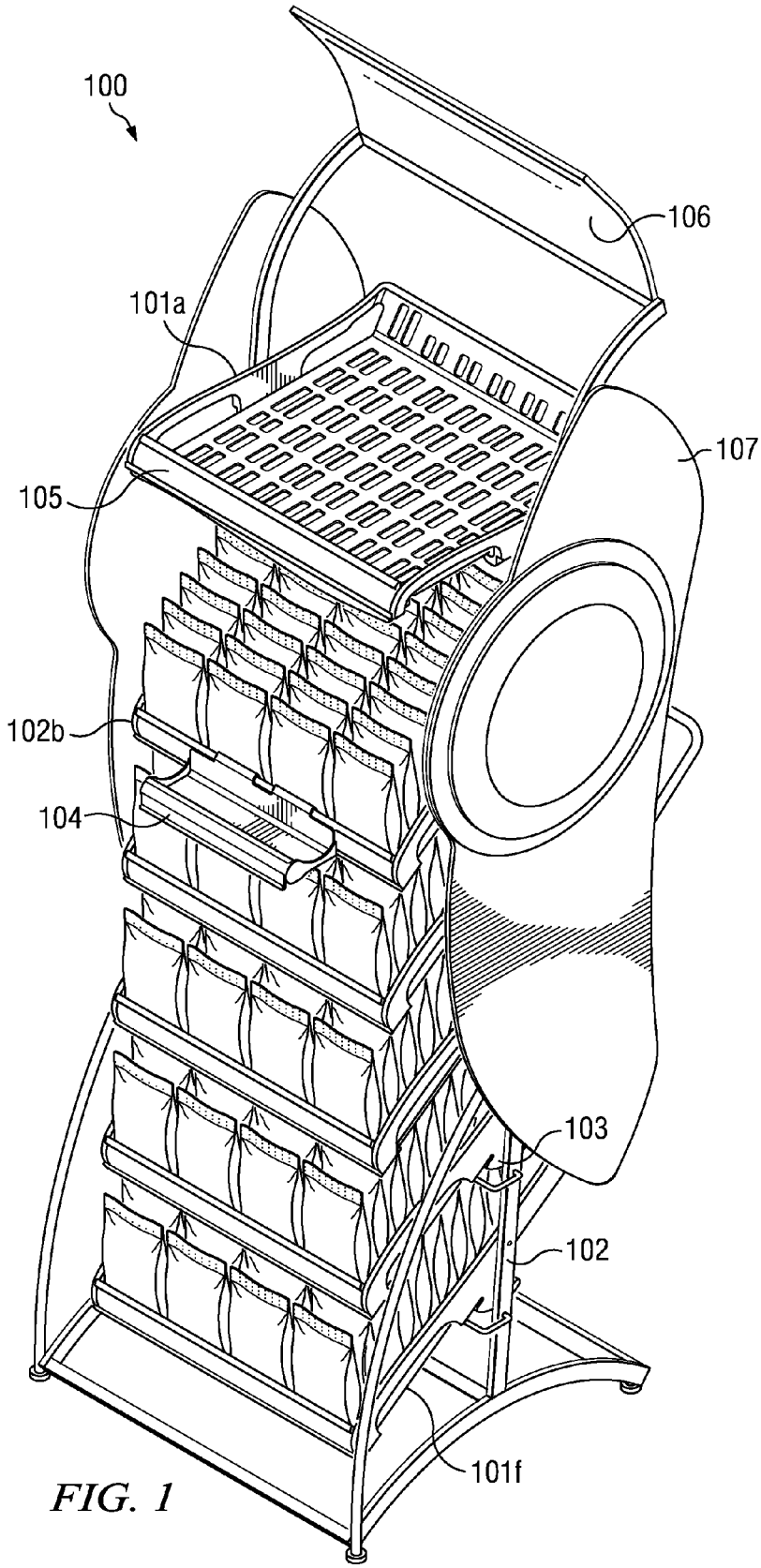
FIG. 1 is a perspective view of a product display rack in one embodiment.

FIG. 1 illustrates a product display rack in one embodiment. A product display rack is a rack which comprises one or more shelves used for displaying product. As depicted the display rack 100 comprises six rows of shelves 101*a-f*. In other embodiments the rack 100 consists only of a single shelf whereas in other embodiments the rack will comprise more than one shelf.

As depicted each row comprises a single shelf 101. In other embodiments at least one row will comprise two shelves coupled in series. In other embodiments two or more shelves will be coupled in series.

The shelves 101*a-f* are coupled to the support frame 102 via a hinge 103. The hinge 103 comprises at least two stable positions. A first stable position corresponds to a loading position and a second stable position corresponds to a displaying position. The loading shelf 101*a* is in the loading stop position. As can be seen, the shelf in the loading position is oriented so that the shelf 101*a* is parallel to a horizontal plane. While in the loading position the shelf 101*a* can be stacked with product. As used herein product refers to any item which can be stocked on a shelf. This includes packages such as boxes, cans, bottles, snack food packages, pillow type packages, etc. In one embodiment product comprises unpackaged materials including, for example, fruit, magazines, books, etc.

After the shelf has been stocked with a quantity of product, it can be adjusted into a displaying position. The bottom five shelves comprise shelves 101*b-f* is a displaying position. In one embodiment the displaying position comprises an orientation wherein the front end of the shelf points in a downward direction. Such an embodiment allows for the shelf to become a gravity feed shelf. A gravity feed shelf is a shelf which utilizes gravity to position the product to a front end of a shelf. For example, if the product comprises a cylindrical can loaded onto its rounded sides, then when the shelf is adjusted to a displaying position the cylindrical can will roll to the front portion of the shelf until it is constrained. The product can be constrained by the shelf or by other product. As an example, if two cylindrical cans are loaded then the first can will be constrained by the shelf whereas the second can will be constrained by the first can. If the first can is removed then the second can will assume the first can's position. While a rolling product has been described this invention is not so limited. Non-rolling product such as boxes slide or otherwise position itself to the front portion of the shelf until it is constrained. In one embodiment the shelf comprises a friction reducing material which limits the friction exerted upon the product and allows the product to slide, roll, or otherwise position itself against a front portion of the shelf.

FIG. 1 also illustrates a support frame 102. The support frame 102 can comprise any frames known in the art. In one embodiment the support frame comprises a metallic support frame. In one embodiment the support frame 102 comprises two support arms parallel to a vertical plane. As depicted, the shelves 101 are coupled to the support arms of the support frame 102.

Also coupled to the support frame 102 is a display 107. A display 107 can comprise advertising material coupled to the support frame 102. The display can comprise any material or graphic designed to grab a consumer's attention. The display can comprise information about the product, sales information, etc.

As depicted, the rack 100 further comprises a balcony 104. As depicted the balcony 104 is coupled to the second shelf 101*b*. The balcony 104 can be coupled to any shelf. In one embodiment the balcony is coupled to each shelf. The balcony 104 provides an additional opportunity to house and display a product. A balcony 104 is discussed in more detail below herein.

FIG. 1 also depicts a label 105. The label 105 can be used to display information about the product including sales price, bar code, product name, etc.

Figure 2:
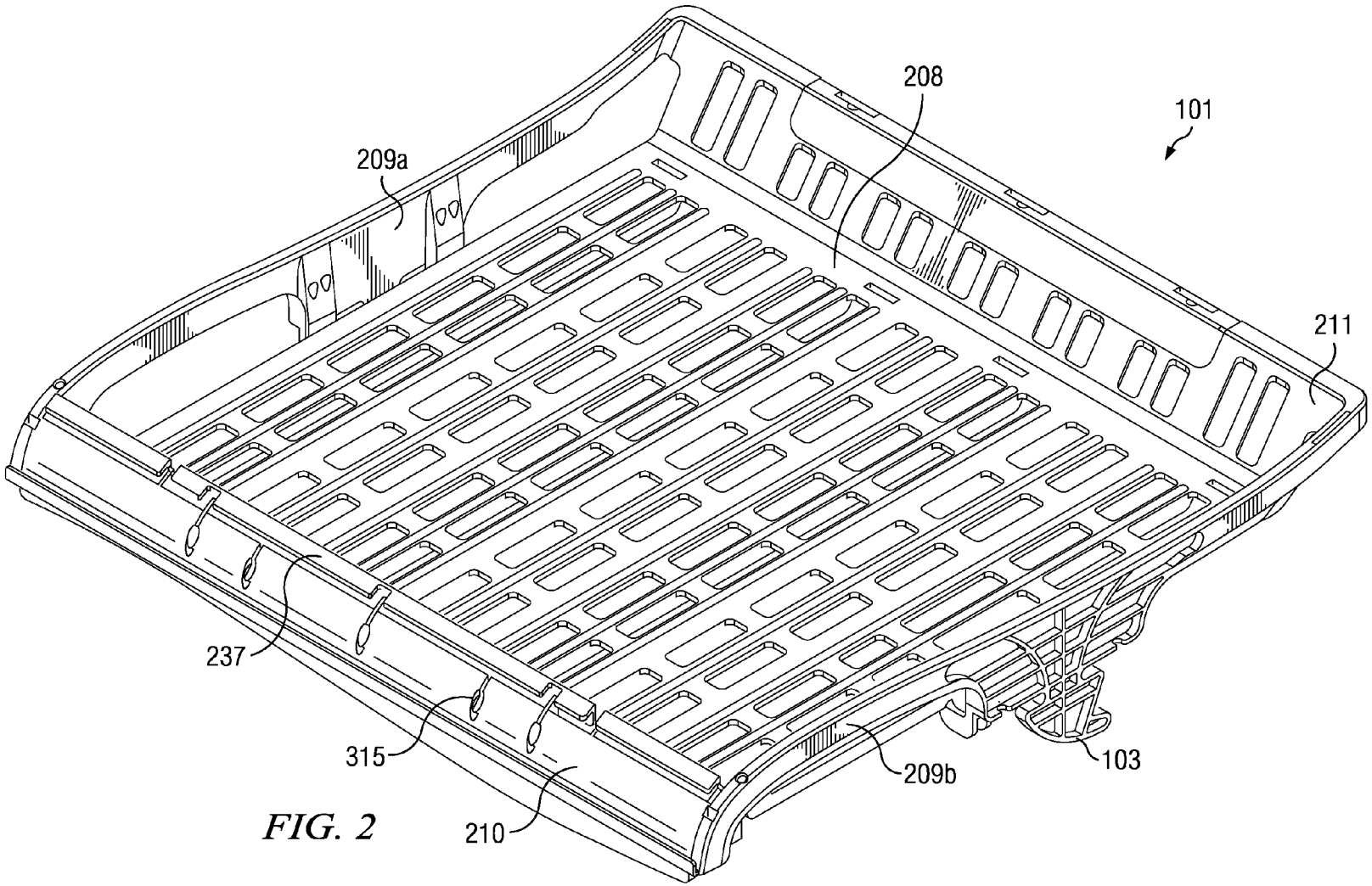
FIG. 2 is a perspective view of an open shelf in one embodiment.

FIG. 2 is a perspective view of an open shelf in one embodiment. An open shelf refers to a shelf 101 which does not comprise a splitter. The shelf 101 depicted comprises a front side 210, a back side 211, and a left side 209*a* and a right side 209*b*. The left 209*a* and right 209*b* sides are collectively referred to as an edge side. In the embodiment depicted the shelf comprises two edge sides, a left 209*a* and a right 209*b*. In other embodiments the shelf comprises only of a single edge. Further, in some embodiments the shelf will comprise all the sides as depicted. In other embodiments the shelf will not comprise one of those sides. As an example, in one embodiment the shelf will not comprise a rear side 211.

Coupled to the edge sides 209*a, b* is the floor 210. The product rests upon the floor 210. As depicted the floor 210 comprises a structural pattern. A structural pattern is where portions of the material are removed but yet the shelf or side remains structurally sound. In one embodiment a structural pattern comprises a lattice pattern. In another embodiment the structural pattern comprises slots where material is missing. A structural pattern need not be a repeating pattern. In one embodiment a shelf comprising a structural pattern comprises a decreased weight compared to a shelf without a structural pattern. This has several benefits. First, the costs associated with shipping of the shelf are decreased because of the decreased weight. Second, in one embodiment if a given rack can safely hold a given amount of weight, by decreasing the weight of the shelves then more product can be safely stored on the rack. Third, in one embodiment the production of a shelf comprising a structural pattern often requires less material compared to a shelf without a structural pattern. Thus, materials costs are decreased with a shelf comprising a structural pattern. Fourth, in one embodiment strategically designing the structural pattern can result in a stronger shelf compared to a shelf without a structural pattern. Finally, in one embodiment the structural pattern allows the product to slide smoothly during gravity feed. In one embodiment the structural pattern comprises elongated slots. Such structural patterns can prevent the package from becoming obstructed by the shelf. For example, in one embodiment, the product comprises a traditional flexible pillow pouch package. Such packages often comprise triangular corners which can snag on the shelf or shelf floor and prevent the product from smoothly gliding during gravity feed. In one embodiment a structural pattern decreases the possibility of a snag by decreasing the possible obstructions which limit the sliding of product. In one embodiment the shelf comprising a structural pattern can hold more weight, exhibit increased rigidity, or exhibit increased flexibility, compared to a shelf without a structural pattern. Those skilled in the art will understand how to design a structural pattern to accomplish the desired attributes.

Any side may comprise a structural pattern. In one embodiment only the floor 208 comprises a structural pattern whereas in other embodiments more than one side comprises a structural pattern.

The shelf 101 further comprises a front 210 coupled to the floor 208. In one embodiment the front 210 maintains product within the shelf 101. The height of the front 210 as well as the other sides can be adjusted depending upon the product stored. In one embodiment the length of the shelves, as measured from the front side 210 to the back side 211, ranges from about 5 inches to about 30 inches. In one embodiment the length ranges from about 15 to about 25 inches. In one embodiment, the width of the shelf, as measured from the left side 209*a* and a right side 209*b*, varies from about 5 to about 30 inches. In one embodiment the width of the shelf ranges from about 15 to about 25 inches. In one embodiment, the height of the shelf, as measured from the bottom of the shelf to the top of the shelf, ranges from about 1 inch to about 8 inches. In one embodiment the height ranges from about 2 inches to about 4 inches. In one embodiment the shelf has dimensions of about 20.5 inches in length, by about 21 inches in width, by about 3.5 inches in height. In one embodiment the front 210 comprises a label mount 237. A label mount 237 is a device which can house a label. Thus, a label can be introduced into the label mount 237 for displaying. In one embodiment the label comprises a bar code, product information, price information, and/or sales specials.

In one embodiment, the shelf 101 also comprises a hinge 103. The hinge 103 will be discussed in more detail below herein. In one embodiment the hinge 103 is integrally manufactured into the shelf 101. In one embodiment the hinge 103 is coupled to the shelf's side edge.

The shelf 101 can comprise a variety of materials. In one embodiment the shelf 101 comprises a polymer. In one embodiment the shelf 101 comprises a plastic. In one embodiment the shelf comprises high density polyethylene. In one embodiment the shelf 101 comprises recycled material. (Are there any other specifics about the materials you would like me to discuss?) In one embodiment the shelf 101 is not metallic. Having the shelf comprise polymer offers several benefits compared to metallic shelves. In one embodiment a polymer shelf weighs less compared to a metallic shelf. This results in decreased shipping costs. In one embodiment a polymer shelf is more resistant to rust than a metal shelf. In one embodiment a polymer shelf has increased durability compared to a metal shelf. With metal shelves the metallic components often wear and/or rust. This often makes adjusting the metallic shelves difficult over time. Polymer shelves avoid this problem. Furthermore, in one embodiment polymer shelves comprise a larger floor surface area compared to metallic shelves. In another embodiment the polymer shelves comprise a smoother surface than metallic shelves. In one embodiment, due to the increased smoothness and surface area, the gravity feed system works better on a polymer shelf compared to a metallic shelf. One reason for this is that the product is often able to glide more smoothly across a polymer shelf than a metallic shelf.

In one embodiment the shelf 101 comprises a single integral piece. In such an embodiment the floor 208, the edge sides 209*a*, 209*b*, the front 210, and the hinge 103 are made as a single piece. Thus, the shelf is integrally made. In one embodiment the shelf 101 is blow molded. In one embodiment the shelf 101 is blow molded from a single die. In one embodiment the shelf comprises a single molded piece.

There are several benefits when the shelf 101 comprises a single integral piece. First, this decreases complexity as the pieces are already connected. Thus, in such an embodiment there is no need to connect separate floor 208 and front 210 pieces together. Second, having an integral piece often increases the strength of the shelf. Third, an integral piece results in increased conformity.

In one embodiment the shelf 101 is stackable. As used herein stackable refers to an object which so conforms with a second object that the first object can be stacked in uniformity upon the second object. In one embodiment wherein the shelf has dimensions of about 20.5 inches by 21 inches by about 3.5 inches, six trays can be stacked to fit within a 24 inch by 21 inch by 15 inch box. Further, in one such embodiment, due to the density of the packaging, a single box comprising six stacked shelves can support the weight of eight additional filled boxes without the need for a double corrugated wall. This embodiment illustrates how compactly shelves can be stacked in one embodiment. Having the ability to be stackable results in decreased shipping costs as more shelves can occupy a given area. Further, this decreases storage costs. Often a retail store will have a quantity of additional shelves in inventory. When the shelves are stackable the quantity of shelves for a given area can be increased. In one embodiment the rack comprises at least two shelves wherein the shelves are substantially identical.

Figure 3A:
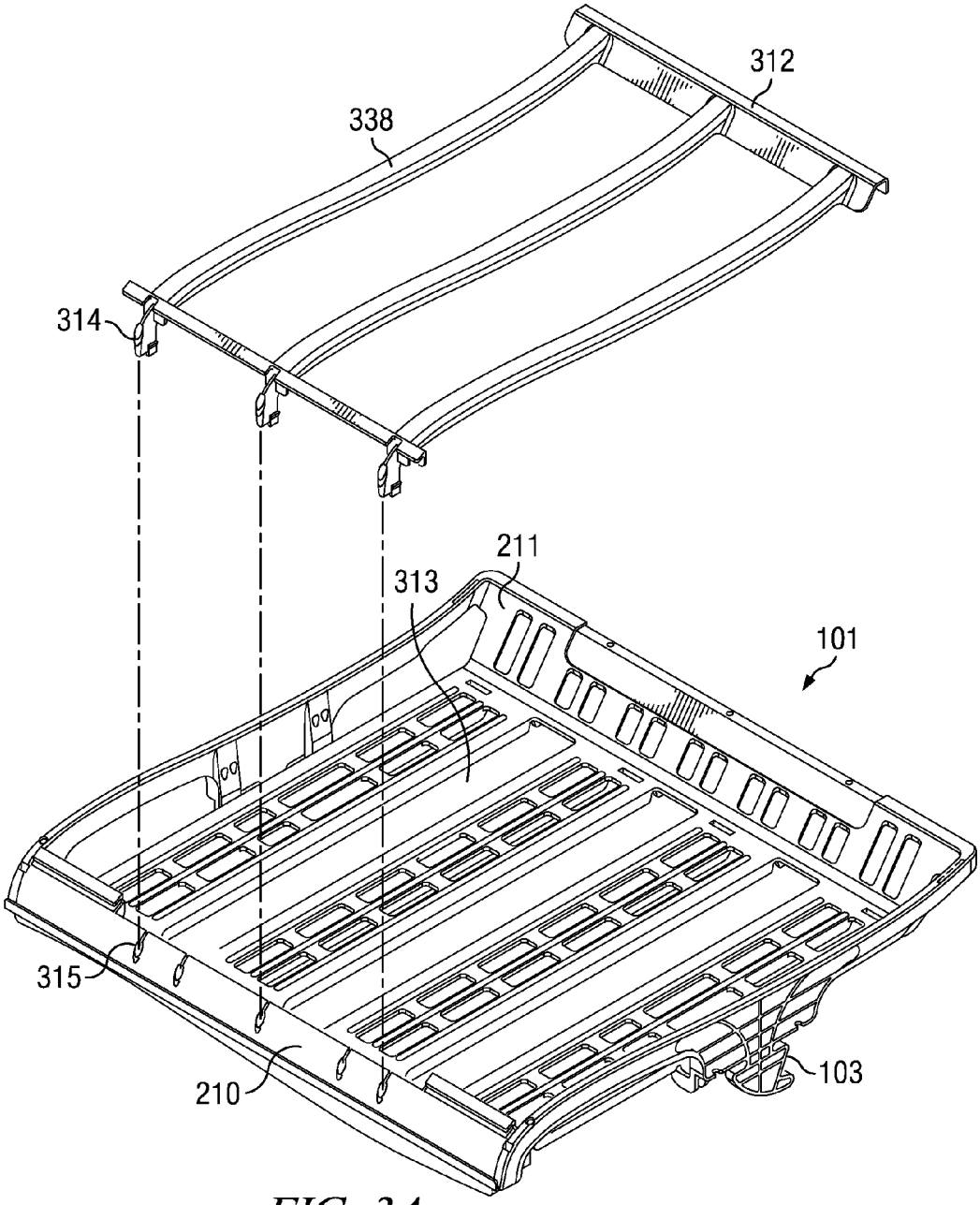
FIG. 3A is a perspective view of a shelf comprising a splitter in one embodiment.

FIG. 3A is a perspective view of a shelf comprising a splitter in one embodiment. A splitter is an object which splits the shelf into a specified number of lanes. As depicted, the splitter 312 splits the shelf 101 into four lanes. Any number of lanes can be created by a splitter. In one embodiment the splitter 312 creates two lanes. In one embodiment the splitter 312 creates three, four, five, six, or more than six lanes. In one embodiment the width of each lane is equal whereas in other embodiments the width of at least two lanes are dissimilar. Lanes allow various size packages to be displayed. As an example, in one embodiment the shelf is 12 inches wide. Thus, a package that is 10 inches wide can be displayed on an open shelf. However, if the package to be displayed is two and a half inches wide, then a splitter can be utilized to create four three-inch lanes. Thus, each shelf will display four lanes of product. In one embodiment the lanes operate as the shelf previously described.

In one embodiment there is a gap 313 in the floor 208 of the shelf 101. In one embodiment the gap 313 comprises an area wherein the floor material is missing. In one embodiment the gap 313 comprises a void. In one embodiment the gap 313 corresponds to a splitter rail 338. A splitter rail 338 is located on the splitter and it splits the lanes. In one embodiment the gap 313 is from about 0.25 inches to about 2 inches wide. Because the splitter rail 338 is located above the gap 313, in one embodiment product does not rest upon the gap 313. Consequently, by having a gap 313 located beneath the splitter rail 338 as opposed to unused floor material, the shelf requires less material to manufacture. This reduces manufacturing costs. Further, because less material is required to manufacture the shelf, the shelf weighs less compared to a shelf without a gap. Furthermore, in one embodiment the gap 313 corresponds to the product edge. In one embodiment a gap 313 prevents the product edge from snagging upon the floor 208 which can prevent gravity feed sliding. As previously described flexible pillow pouches often form a triangular edge. In one embodiment the gap prevents the triangular edge from snagging on the floor 208 and prevents sliding. In other embodiments, the shelf does not comprise a gap 313.

In one embodiment, the shelves have common dimensions. In one embodiment two or more shelves have the same width and/or length. In one embodiment the only difference between an open shelf, like the shelf depicted in FIG. 2, and a multi-lane shelf like that depicted in FIG. 3A, is the floor 208. As discussed, some multi-lane embodiments comprise a gap 313 in the floor 208. Consequently, if manufacturing the shelf from a die, only the portion related to the floor need be changed. The shared features reduce the cost and expense of designing multiple dies.

Figure 3B:
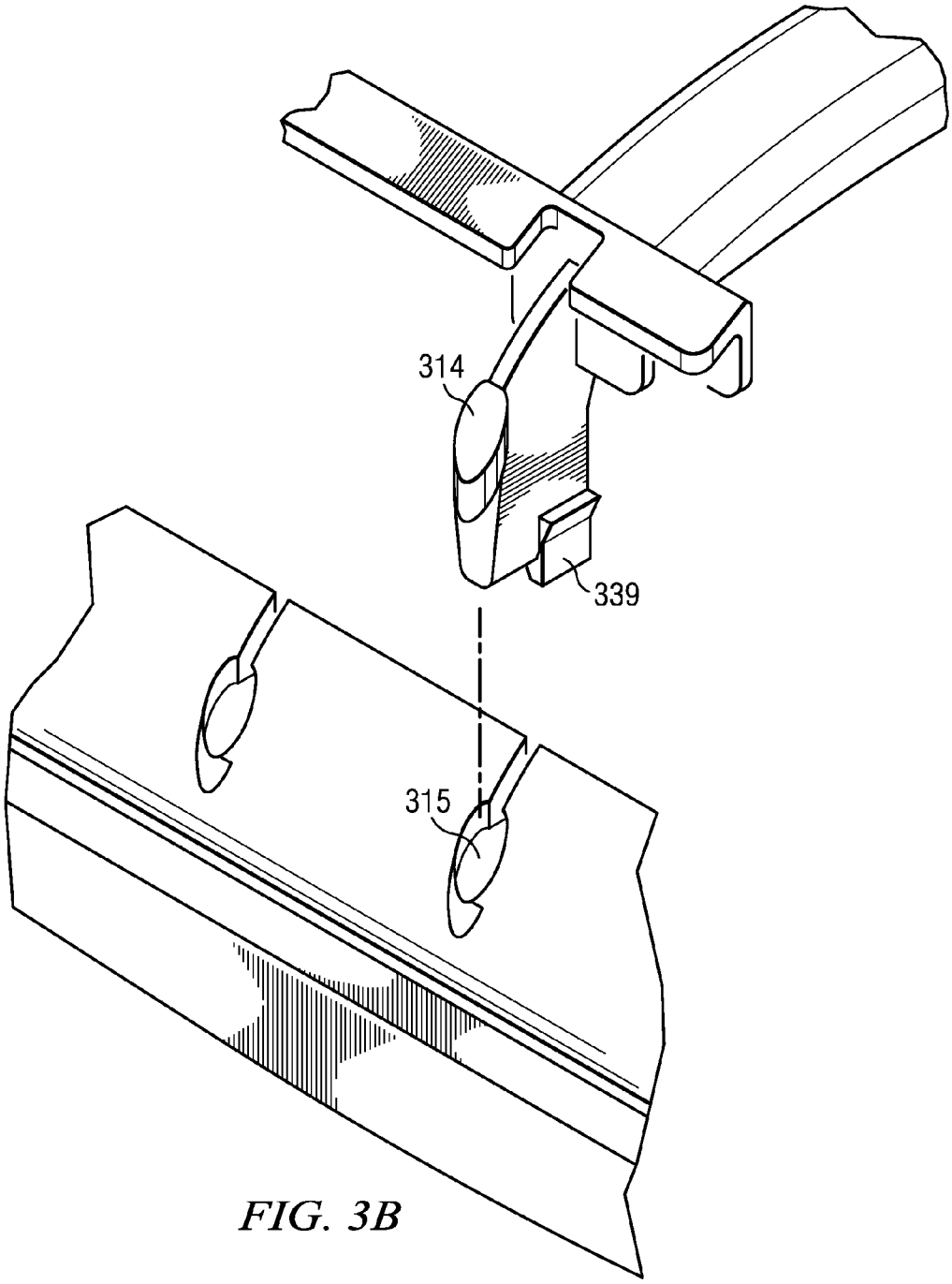
FIG. 3B is an enlarged perspective of the splitter mounting tabs in one embodiment.

The splitter 312 can be coupled to the shelf in a variety of methods. The splitter 312 can be screwed, bolted, or otherwise affixed. In one embodiment the splitter 312 is removably coupled to the shelf 101. In one embodiment the splitter is coupled to the shelf 101 in a way that does not require additional parts such as screws, nails, etc. This reduces the complexity of installation. In one embodiment the splitter 312 can be removed from the shelf 101 when desired. One such example is if the shelf 101 is going to be stored then the splitter 312 can be removed so that two or more shelves 101 can be stacked upon one another. In one embodiment the splitter 312 snaps to the shelf 101 via splitter mounting tabs 314. FIG. 3B is an enlarged perspective of the splitter mounting tabs in one embodiment. In one embodiment the splitter mounting tabs 314 are sized so as to mate with a tab base 315 located on the shelf 101. In one embodiment the splitter mounting tabs 314 mate with the tab base 315 via snapping. The mounting tabs 314 are inserted into the tab base 315. In one embodiment the mounting tabs 314 expand after insertion through the tab base 315. In one embodiment the mounting tabs 314 are secured to the tab base 315 via friction. As depicted the mounting tab 314 comprises a lock 339 which prevents the splitter 312 from disengaging the shelf 101 until a necessary force overcomes the lock 339. While a snapping device for securing the splitter 312 with the shelf 101 has been described, those skilled in the art will understand other methods and devices for accomplishing the same.

Referring back to FIG. 2, as depicted the front side 210 of the shelf comprises a tab base 315. As depicted the tab base 315 is utilized by the label mount 237. It can be seen, however, that if the label mount 237 is withdrawn a splitter 312 can be coupled via the tab base 315. This illustrates the adaptability of the shelf in one embodiment.

Figure 4:
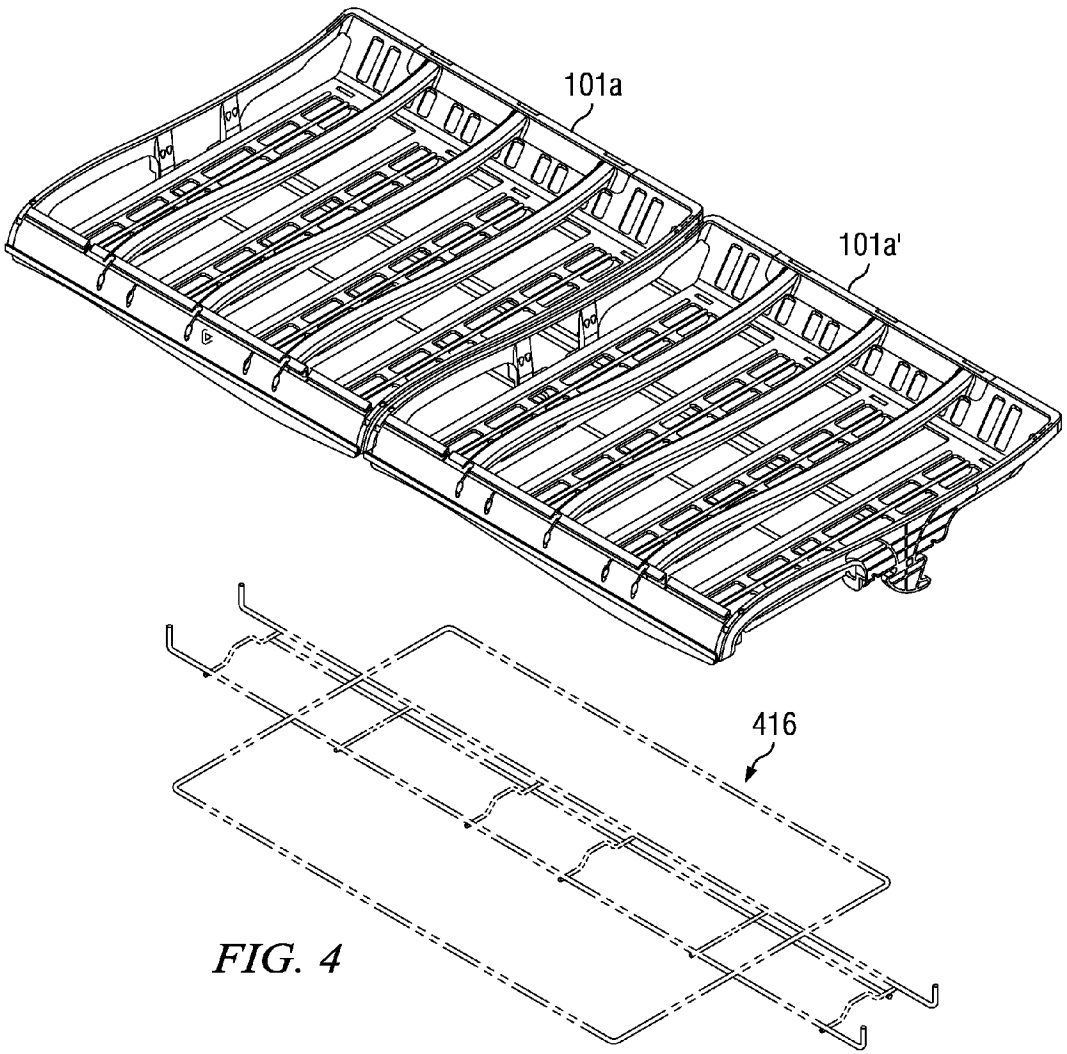
FIG. 4 shows a perspective view of two shelves in series in one embodiment.

In one embodiment it is desirable that two shelves be placed in series. One such example is when the rack is three feet wide while the shelves are one foot wide. In such an embodiment it is often desirable to place three shelves in series. FIG. 4 shows a perspective view of two shelves in series in one embodiment. In one embodiment the shelves 101*a*, 101*a*' are the same width whereas in other embodiments the coupled shelves comprise dissimilar widths.

In one embodiment the coupled shelves 101*a*, 101*a*' comprise the same number of lanes. For example, in one embodiment each shelf will comprise an open shelf. In other embodiments, such as that depicted in FIG. 4, each shelf 101*a*, 101*a*' will comprise multiple lanes. In other embodiments two or more shelves will comprise different number of lanes. For example, one shelf will comprise an open shelf whereas the adjacent shelf will comprise a splitter making four lanes. Thus, the left shelf can display a wider product whereas the right shelf can display narrower product.

In one embodiment each shelf 101*a*, 101*a*' comprises uniform dimensions as discussed above. Those skilled in the art will understand that uniform dimensions provide increased versatility. For example, the left shelf 101*a* in FIG. 4 can be replaced with an open shelf. This allows the rack owner to display many different types of product.

The shelves 101*a*, 101*a*' in series can be coupled in many different ways. In one embodiment edge sides from adjacent shelves are coupled. In one embodiment at least one edge side from one shelf comprises a male attachment device which couples with a female attachment device on an adjacent shelf.

In one embodiment the shelves further comprise a weight support. A weight support is any device coupled to a shelf which offers the shelf support. The weight support can comprise wire, fabric, tape, etc. In one embodiment the weight support comprises a wire structure 416 which couples to at least one shelf. In one embodiment the wire structure 416 couples to at least two shelves, whereas in another embodiment the wire structure 416 couples with each shelf in the series. The wire structure 416 can be coupled to the shelf in a variety of methods. In one embodiment the shelf comprises a wire nook which can receive the wire structure 416.

In one embodiment, only the outermost shelves are coupled to the support frame. As depicted in FIG. 4 the hinge 103 on the left side of the left shelf 101*a* and the hinge on the right side of the right shelf 101*a*' both affix to the support frame. The right side of the left shelf 101*a* and the left side of the right shelf 101*a*' are coupled. In one embodiment this coupling is sufficient to hold product and a weight support is not necessary. In other embodiments, a weight support is utilized to offer additional support.

Figure 5:
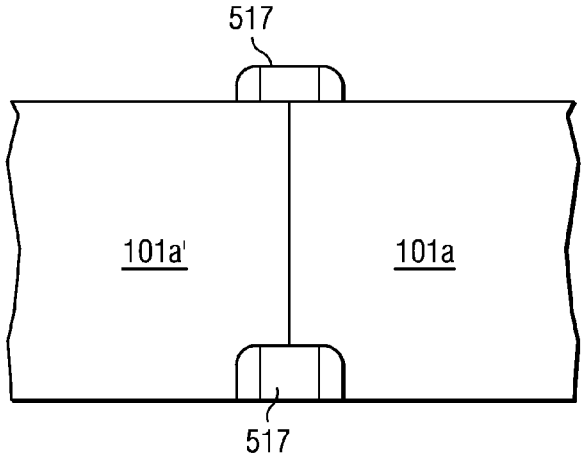
FIG. 5 is a rear planar view of two coupled shelves in one embodiment.

FIG. 5 is a back planar view of two coupled shelves in one embodiment. FIG. 5 is a simplified figure and only demonstrates the clip 517. In the figure a clip 517 couples shelves 101*a*, 101*a*' together. A clip 517 can comprise a wire, a vise, a spring, or other device which secures two adjacent objects together. In one embodiment the shelves 101*a*, 101*a*' are clipped from below. In one embodiment the shelves are coupled with a clip from above. One skilled in the art will understand the various ways to couple to adjacent shelves together.

Figure 6:
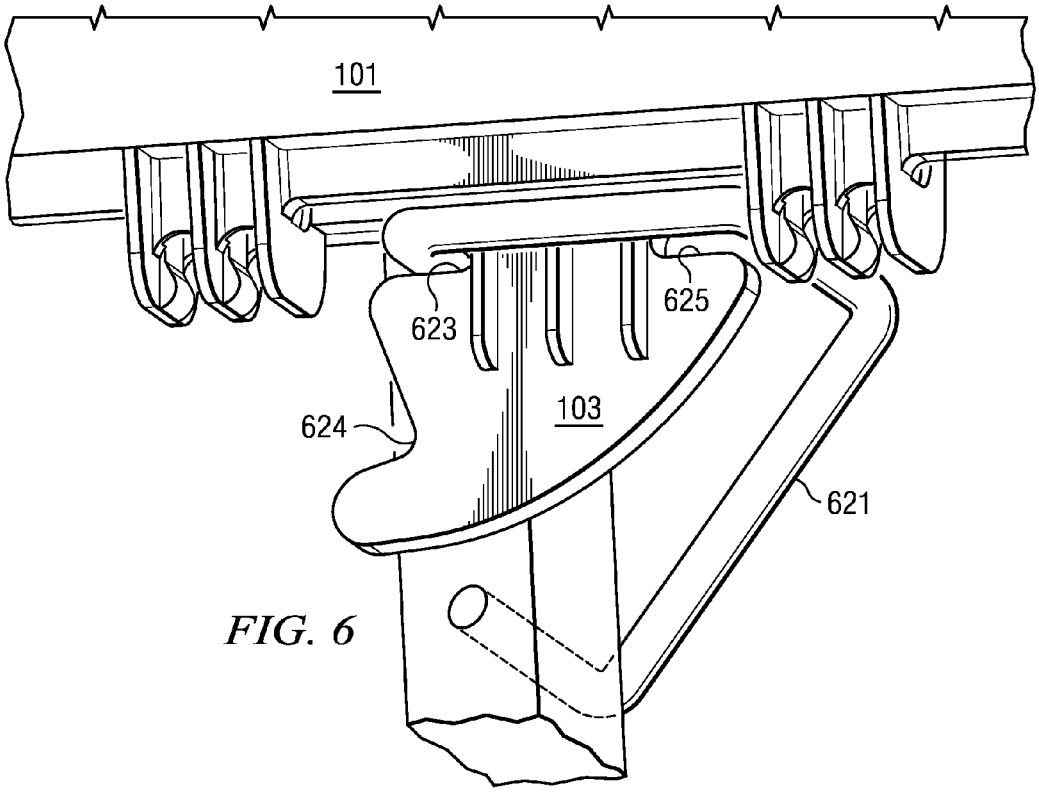
FIG. 6 is a perspective view of the hinge in one embodiment.

FIG. 6 is a perspective view of the hinge in one embodiment. As depicted in FIG. 6, the hinge 103 is oriented to the loading position. FIG. 6 illustrates the affixing device 621 which couples the hinge 103 to the support frame 102. The affixing device 621 can comprise any device which affixes the hinge to the support frame 102. In one embodiment the affixing device 621 comprises a wire. In one embodiment the affixing device 621 comprises a rod. In one embodiment the affixing device 621 comprises a bent rod.

In one embodiment the affixing device 621 is coupled to the support frame in one location. In another embodiments, such as the embodiment depicted in FIG. 6, the affixing device 621 couples to the support frame in at least two locations. In one embodiment the affixing device 621 is stationary.

As depicted the hinge 103 comprises three nooks. In other embodiments the hinge 103 comprises two nooks, while in other embodiments the hinge 103 comprises more than three nooks. A nook is a cavity which can engage the affixing device 621. As depicted in FIG. 6, the left nook 623 engages the affixing device 621. In one embodiment the position of the shelf is adjusted by manipulating the shelf so that the affixing device 621 engages a dissimilar nook. As depicted the hinge 103 additionally comprises a right nook 625 and a bottom nook 624. As depicted the left nook 623 and the right nook 625 are located above the bottom nook 624. While a hinge 103 comprising three nooks is described in detail, this description should not be deemed limiting. Those skilled in the art will understand that hinges with varying number of nooks can also be utilized. Further, one skilled in the art will understand that various hinges can be utilized.

Figure 6A:
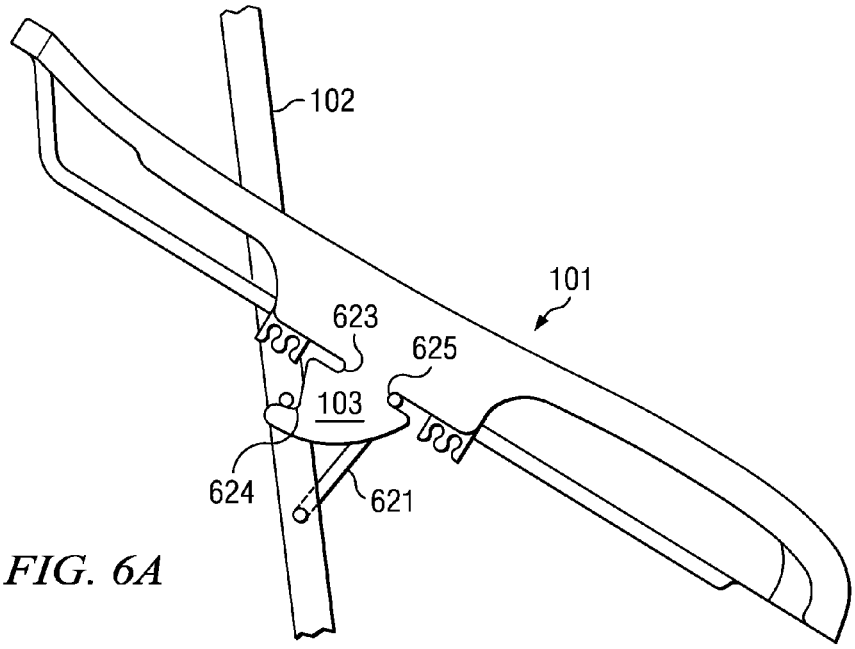
FIG. 6A shows a side planar view of the shelf in a display position in one embodiment.

FIG. 6A shows a side planar view of the shelf in a display position in one embodiment. The shelf is pointed downward so that it can operate as a gravity feed shelf. The angle of declination can vary depending on the product being displayed. In one embodiment the shelf is angled from about 91° to about 160°. Because the shelf in a display position can hold product, and because the position is secure, the display position is a stable position.

In FIG. 6A the right nook 625 engages the affixing device 621 and the affixing device 621 prevents the shelf 101 from falling downward. Thus, the affixing device 621 secures the shelf at the top right nook 625. Additionally, the bottom nook 624 engages the affixing device 621. The affixing device 621 prevents the shelf 101 from falling downward. As can be seen, if a downward force is applied to the front side of the shelf 101 the affixing device 621 overcomes this downward force and prevents the shelf 101 from moving. However, as depicted, the affixing device 621 allows the shelf 101 to pivot. Thus, if an upward force is applied to the front of the shelf 101, the shelf will pivot about the affixing device 621 in a counterclockwise direction. In such an embodiment the shelf is converted from a display position to a loading position by manipulating the shelf relative to the affixing device 621.

In one embodiment the hinge 103 is located to the rear of the shelf's center of gravity. This ensures that the shelf, if left unrestrained, will achieve the display position.

Figure 6B:
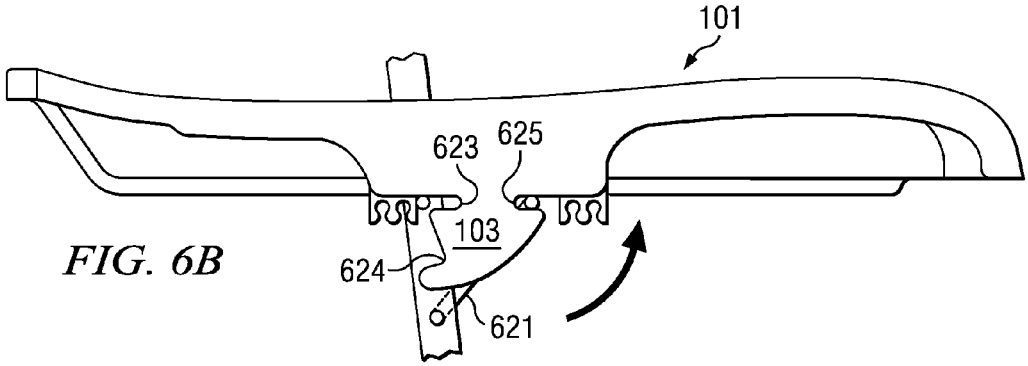
FIG. 6B shows a side planar view of the shelf in a transition position in one embodiment.

FIG. 6B shows a side planar view of the shelf in a transition position in one embodiment. FIG. 6B shows the orientation after an upward force has been applied to a shelf in the loading position. As depicted the bottom nook 624 no longer engages the affixing device 621. As can be seen, the shelf in 6B is not in a secured position and is therefore not a stable position. Thus, if product were loaded into the shelf the product weight would apply a force upon the shelf, and the shelf would revert to the loading position.

Figure 6C:
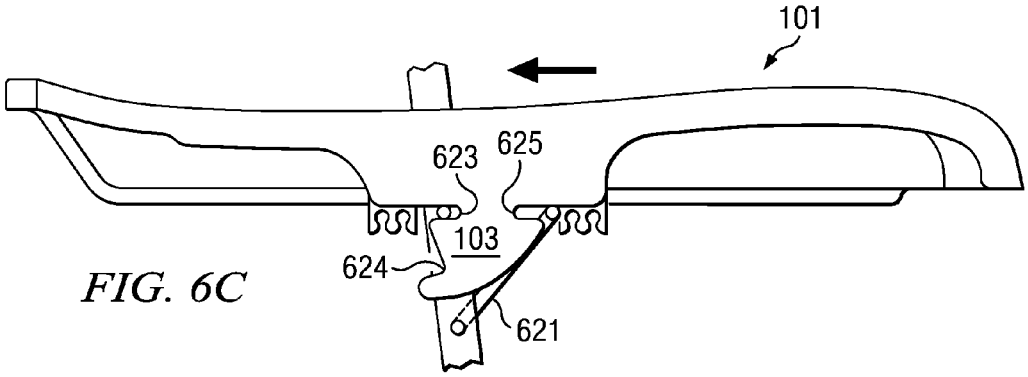
FIG. 6C shows a side planar view of the shelf in a loading position in one embodiment.

FIG. 6C shows a side planar view of the shelf in a loading position in one embodiment. In one embodiment to move from the transitional position of FIG. 6B to the loading position of 6C the shelf is pushed laterally until the first left nook 623 engages the affixing device 621. As depicted in FIG. 6C the affixing device 621 engages the left nook 623 and prevents the shelf from rotating upward or downward. Thus, the shelf 101 is in a secure and stable position. As can be seen, the floor of the shelf is parallel to a horizontal plane which often allows for easier loading. To turn the shelf 101 from the loading position to a display position the steps are simply reversed. Thus, the shelf 101 is pulled laterally so that the affixing device 621 no longer engages the left nook. At this point the transitional position depicted in FIG. 6B has been obtained. Thereafter the shelf is pivoted clockwise until the affixing device 621 engages the bottom nook 624. At this point the display position of FIG. 6A has been obtained.

Figure 7:
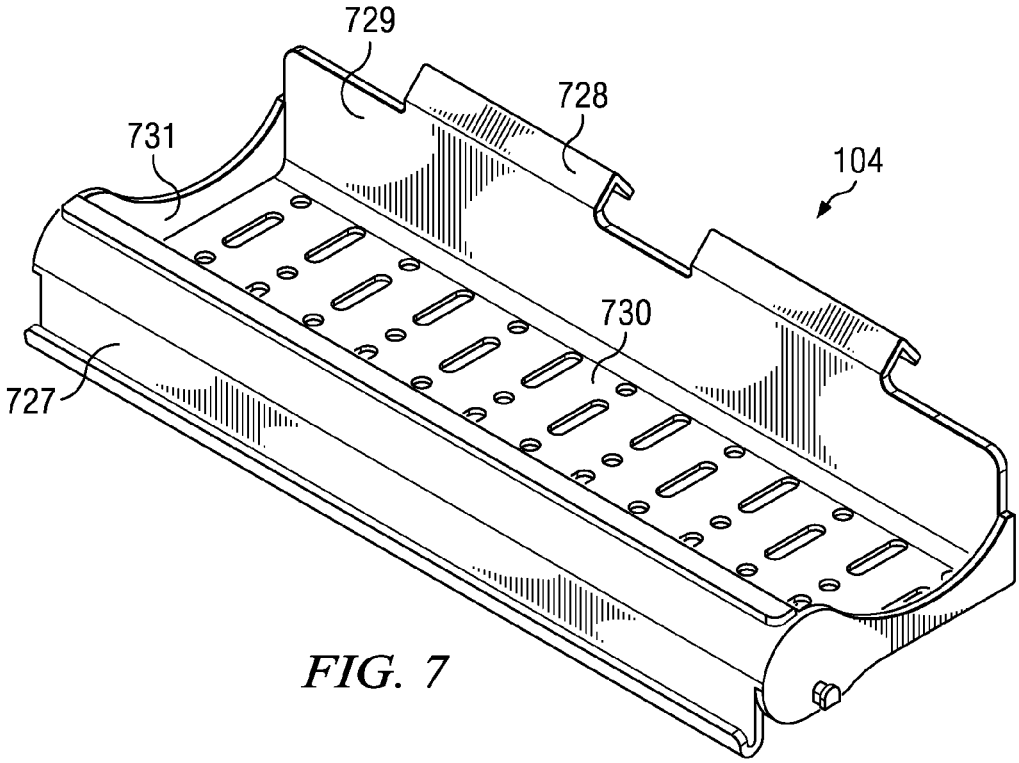
FIG. 7 shows a perspective view of a balcony in one embodiment.

FIG. 7 shows a perspective view of a balcony in one embodiment. As depicted the balcony 104 has a front side 727, a rear side 729, a left side 731*a*, a right side 731*b*, and a floor side 730. In other embodiments one or more of the sides will be missing. For example, in one embodiment the balcony 104 does not comprise left 731*a* or right sides 731*b*.

The balcony 104 can be coupled to the rack 100 in a variety of ways. In one embodiment the balcony 104 couples to a front side of a shelf. As depicted the balcony 104 comprises clips 728 which mount to a front side of a shelf. In such an embodiment the balcony 104 can be installed and removed with ease. In such an embodiment the weight of the balcony 104 and its contents act upon the clips 728 to ensure the balcony 104 remains attached.

The balcony 104 can be used to store and display product. In one embodiment the balcony 104 displays smaller product than the shelf 101. For example, the shelf 101 can house snack chips whereas the balcony 104 comprises candy. Additionally, in one embodiment the front side 727 of the balcony comprises a label mount which can display sales information, bar code information, etc. as previously described.

In one embodiment one or more sides of the balcony 104 comprises a structural pattern. This can help to decrease the weight of the balcony 104 so that comparatively more product may be stored and displayed on the balcony 104.

In one embodiment the rack comprises only a single balcony 104. In other embodiments the rack 100 comprises more than one balcony 104.

The balcony 104 can comprise any material previously discussed. In one embodiment the balcony 104 comprises the same material as the shelf 101. In one embodiment the balcony 104 is blow molded. In one embodiment the balcony 104 comprises a single piece.

Figure 8:
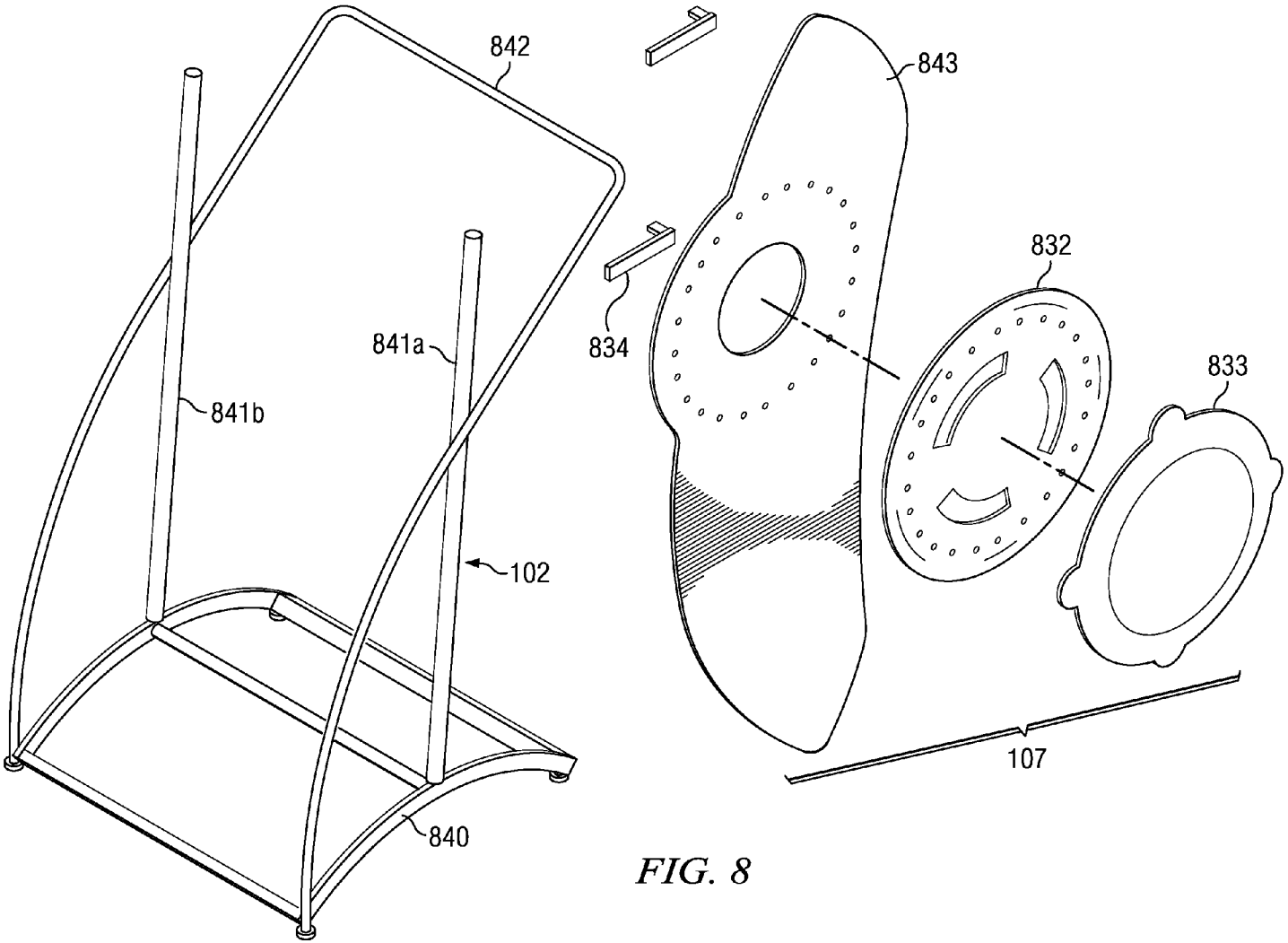
FIG. 8 depicts an exploded perspective view of the display in one embodiment.

FIG. 8 depicts an exploded perspective view of the display in one embodiment. FIG. 8 shows the support frame comprising a base 840, two support arms 841*a*, 841*b*, and a cross member 842. As depicted the support arms 841*a*, 841*b* are oriented to be parallel to a vertical plane. The cross member 842 increases the structural rigidity of the support frame 102. Some embodiments do not comprise a cross member 842. The cross member 842 can be made of the same or different material as the support arms 841*a*, 841*b*.

In one embodiment the support frame 102 comprises at least one hole. In one embodiment, the at least one hole is utilized to couple the affixing device 621. The at least one hole can also be utilized to affix the display 107. In one embodiment the display 107 is coupled via a display mount 834. The display mount 834 affixes to the support frame 102. In one embodiment the display mount 834 affixes via said at least one hole in the support frame 102. In other embodiments the display mount 834 is affixed via a clamp. In one embodiment the display mount 834 couples to the support frame 102 at two locations. As an example, in one embodiment the display mount 834 is attached to the support frame 102 with two screws. The display mount 834 can couple to the display 107 in any method known in the art. In one embodiment, as depicted in FIG. 8, the display mount 834 couples with the display cover 833. The display cover 833 couples with the display support 832, and the display support 832 couples to the display base 843. In one embodiment the display base 843, the display cover 833, and/or the display support 832 comprise graphics. In one embodiment the display 107 refers collectively to the display base 843, the display cover 833, and the display support 832. In one embodiment the display comprises the same material as the shelf. In one embodiment the display 107 comprises a plurality of small holes which allow a variety of graphic members to be coupled to the display 107. This allows graphics to be easily replaced for example, to signal the beginning of a new sale.

While the invention has been particularly shown and described with reference to a preferred embodiment, it will be understood by those skilled in the art that various changes in form and detail may be made therein without departing from the spirit and scope of the invention.

I claim:

1. A product display rack comprising:

a support frame;

at least one shelf, wherein said shelf comprises a floor side, a front side, at least one edge side, and a hinge associated with said at least one edge side, wherein said floor side, said front side, said at least one edge side, and said hinge are integrally made, and said front side and said at least one edge side extends above the floor side, the at least one shelf having a center of gravity and the hinge affixed to the at least one shelf to the rear of the center of gravity, the hinge having a first nook on a first side of the hinge, a second nook laterally opposite the first nook on an opposite side to the first side, and a third nook on the opposite side of the hinge;

an affixing device coupling said hinge to said support frame;

wherein said hinge comprises at least two stable positions, a first stable position corresponding to a loading position wherein the affixing device engages a first nook and the laterally opposite second nook, and a second stable position corresponding to a displaying position wherein the affixing device engages the first nook and the opposite third nook, the shelf transformed from the display position to the loading position by first rotating the front side upward to disengage the third nook and to orient the shelf horizontally, then moving the shelf laterally backward toward the support frame to and engage the affixing device with the second nook, and wherein said hinge extends downward below said floor side;

wherein said display rack further comprises a splitter, the splitter including laterally extending splitter rails coupled to each other in spaced apart relation with longitudinally extending rail couplers, and wherein said floor side of said at least one shelf comprises a gap, wherein said splitter rails are located above said gap.

2. The product display rack of claim 1 wherein said loading position facilitates loading of said shelf with product, and wherein said displaying position facilitates displaying and gravity feed dispensing of product on said shelf.

3. The product display rack of claim 1 wherein said at least one shelf further comprises a rear side, wherein said rear side is integrally made with said floor side.

4. The product display rack of claim 1 wherein said at least one shelf comprises plastic.

5. The product display rack of claim 1 wherein said at least one shelf is blow molded.

6. The product display rack of claim 1 wherein said splitter separates the at least one shelf into two lanes.

7. The product display rack of claim 1 wherein said splitter is removably coupled to said shelf.

8. The product display rack of claim 7 wherein said splitter is removably coupled via splitter mounting tabs.

9. The product display rack of claim 1 wherein said splitter separates said shelf into 3 lanes.

10. The product display rack of claim 1 wherein said splitter separates said shelf into 4 lanes.

11. The product display rack of claim 1 further comprising a balcony coupled to a front side of said at least one shelf.

12. The product display rack of claim 1 further comprising a display.

13. The product display rack of claim 1 wherein said at least one shelf comprises at least two shelves in series, wherein said shelves are coupled via said at least one edge side.

14. The product display rack of claim 13 wherein at least one of said at least two shelves comprises a mounting tab.

15. The product display rack of claim 13 wherein said at least two shelves in series are coupled to a weight support.

16. The product display rack of claim 15 wherein said weight support comprises a wire.

17. The product display rack of claim 1 wherein said at least one shelf comprises at least one side which comprises a structural pattern.

18. The product display rack of claim 1 wherein said at least one shelf comprises at least two shelves, and wherein each of said at least two shelves is stackable.

19. The product display rack of claim 1 wherein said at least one shelf comprises at least two shelves, and wherein each of said at least two shelves is substantially identical.

20. The product display rack of claim 1 wherein said at least one shelf comprises a single molded piece.

21. The product display rack of claim 1 wherein said affixing device is a detachable device.

22. The product display rack of claim 1 wherein said affixing device is selected from the group consisting of at least one wire or at least one rod.

23. The product display rack of claim 1 wherein said gap comprises an area wherein said floor side is missing.

24. The product display rack of claim 1 wherein said gap comprises a void.

* * * * *